US010267310B2

(12) United States Patent
Tanasuca et al.

(10) Patent No.: US 10,267,310 B2
(45) Date of Patent: Apr. 23, 2019

(54) VARIABLE PRESSURE PUMP WITH HYDRAULIC PASSAGE

(71) Applicant: MAGNA POWERTRAIN INC., Concord (CA)

(72) Inventors: Cezar Tanasuca, Richmond Hill (CA); David R. Shulver, Richmond Hill (CA); Hans Jürgen Lauth, Neu Anspach (DE)

(73) Assignee: MAGNA POWERTRAIN INC., Concord (CA)

( * ) Notice: Subject to any disclaimer, the term of this patent is extended or adjusted under 35 U.S.C. 154(b) by 114 days.

(21) Appl. No.: 15/301,899

(22) PCT Filed: Apr. 13, 2015

(86) PCT No.: PCT/IB2015/052680
§ 371 (c)(1),
(2) Date: Oct. 4, 2016

(87) PCT Pub. No.: WO2015/159201
PCT Pub. Date: Oct. 22, 2015

(65) Prior Publication Data

US 2017/0184096 A1 Jun. 29, 2017

Related U.S. Application Data

(60) Provisional application No. 61/979,030, filed on Apr. 14, 2014.

(51) Int. Cl.

| | |
|---|---|
| ***F03C 4/00*** | (2006.01) |
| ***F04C 14/18*** | (2006.01) |
| ***F04C 2/00*** | (2006.01) |
| ***F04C 14/22*** | (2006.01) |
| ***F01M 1/02*** | (2006.01) |

(Continued)

(52) U.S. Cl.
CPC ..... *F04C 14/226* (2013.01); *F01M 1/02* (2013.01); *F01M 1/16* (2013.01); *F04C 2/336* (2013.01);

(Continued)

(58) Field of Classification Search
CPC ..... F04C 2/336; F04C 2/344; F04C 14/226; F04C 14/24; F04C 2240/30; F01M 1/02;

(Continued)

(56) References Cited

U.S. PATENT DOCUMENTS 8,047,822 B2 * 11/2011 Shulver ..... F04C 14/226 418/26
2008/0247894 A1 * 10/2008 Lutoslawski ..... F04C 2/3442 418/27

(Continued)

FOREIGN PATENT DOCUMENTS

CN 101084378 A 12/2007
EP 0049838 A1 * 4/1982 ..... F04C 14/226
WO WO-2007048382 A1 5/2007

*Primary Examiner* — Theresa Trieu
(74) *Attorney, Agent, or Firm* — Harness, Dickey & Pierce, P.L.C.

(57) ABSTRACT

A variable capacity pump includes a control ring moveable within a pump chamber to alter the volumetric capacity of the pump. First and second control chambers individually receive pressurized fluid to create forces to bias the control ring in a predetermined direction. A return spring urges the control ring toward a maximum volumetric capacity pump position. The control ring connects and disconnects the second control chamber from a source of pressurized fluid based on a position of the control ring. Forces from the control chambers and the spring act in combination with one another or against one another and against the spring force to establish first and second equilibrium pressures based on a pressurized or vented condition of the second control chamber.

28 Claims, 15 Drawing Sheets

(51) Int. Cl.

| | |
|---|---|
| ***F04C 2/344*** | (2006.01) |
| ***F04C 2/336*** | (2006.01) |
| ***F04C 14/24*** | (2006.01) |
| ***F01M 1/16*** | (2006.01) |

(52) U.S. Cl.
CPC ..... *F04C 2/344* (2013.01); *F04C 14/24* (2013.01); *F01M 2001/0238* (2013.01); *F01M 2001/0246* (2013.01); *F04C 2240/30* (2013.01)

(58) Field of Classification Search
CPC ..... F01M 1/16; F01M 2001/0238; F01M 2001/0246
USPC ..... 418/24, 26–27, 30, 259; 417/213, 417/218–220, 310
See application file for complete search history.

(56) References Cited

U.S. PATENT DOCUMENTS

| | | | | |
|---|---|---|---|---|
| 2009/0022612 | A1* | 1/2009 | Williamson | F04C 14/226 418/26 |
| 2009/0047147 | A1 | 2/2009 | Yamamuro | |
| 2010/0028171 | A1* | 2/2010 | Shulver | F04B 49/00 417/213 |
| 2010/0226799 | A1 | 9/2010 | Watanabe et al. | |
| 2011/0300015 | A1 | 12/2011 | Kirchner et al. | |
| 2013/0028770 | A1 | 1/2013 | Niwata et al. | |
| 2013/0343940 | A1* | 12/2013 | Ammon | F04C 14/226 418/26 |
| 2015/0252803 | A1* | 9/2015 | Ohnishi | F04C 14/226 418/26 |

* cited by examiner

VARIABLE PRESSURE PUMP WITH HYDRAULIC PASSAGE

FIELD

The present invention relates to variable displacement vane pumps. More specifically, the present invention relates to a variable displacement variable pressure vane pump system for mechanical systems such as internal combustion engines or automated transmissions. The present disclosure relates to an improved pump and control device for providing better control of the output of the variable capacity pump. More specifically, the present invention relates to a flow demand optimized control mechanism to control the output of a variable capacity pump at different operating conditions.

BACKGROUND

Pumps for incompressible fluids, such as oil, are often variable capacity vane pumps. Such pumps include a moveable pump ring, which allows the rotor eccentricity of the pump to be altered to vary the capacity of the pump.

Having the ability to alter the volumetric capacity of the pump to maintain an equilibrium pressure is important in environments such as automotive lubrication pumps, wherein the pump will be operated over a range of operating speeds. In such environments, to maintain a comparatively equilibrium pressure it is known to employ a direct, or indirect, feedback supply of the working fluid (e.g. lubricating oil) from the output of the pump to a control chamber adjacent the pump control ring, the pressure in the control chamber acting to move the control ring, against a biasing force, typically from a return spring, to alter the capacity of the pump.

When the pressure at the output of the pump increases, such as when the operating speed of the pump increases, the increased pressure is applied to the control ring to overcome the bias of the return spring and to move the control ring to reduce the capacity of the pump, thus reducing the output volume and hence the pressure at the output of the pump, to continue to maintain a comparatively equilibrium pressure despite the change in operating conditions, (speed).

Conversely, as the pressure at the output of the pump drops, such as when the operating speed of the pump decreases, the decreased pressure applied to the control chamber adjacent the control ring allows the biasing force, typically from a return spring, to move the control ring to increase the capacity of the pump, raising the output volume and hence pressure of the pump, to continue to maintain a comparatively equilibrium pressure despite the change in operating conditions. In this manner, a comparatively equilibrium pressure is obtained at the output of the pump over a range of operating conditions (speeds).

The equilibrium pressure is determined by the area of the control ring against which the working fluid in the control chamber acts, the pressure of the working fluid supplied to the chamber and the bias force, typically generated by the return spring and the characteristics of the hydraulic system that the pump operates within.

Conventionally, the equilibrium pressure is selected to be a pressure which is acceptable for the expected operating range of the engine and is thus somewhat of a compromise as, for example, the engine may be able to operate acceptably at lower operating speeds with a lower working fluid pressure than is required at higher engine operating speeds. In order to prevent undue wear or other damage to the engine, the engine designers will select an equilibrium pressure for the pump which meets the worst case (for example, high engine load or operating speed) conditions. Thus, at lower speeds, or lower engine loads, the pump will be operating at a higher capacity than necessary, wasting energy pumping the surplus, unnecessary, working fluid through the hydraulic system.

It is desired to have a simple variable capacity vane pump that can provide at least two equilibrium pressures in reasonably compact pump housing. Some prior art solutions use a dual spring configuration, as shown for example in WO2013049929 A1. It may be desirable to achieve similar benefits by using simple hydraulic connections, without the need for additional components.

SUMMARY

It is an object of the present invention to provide a novel variable displacement variable pressure vane pump which obviates or mitigates at least one disadvantage of the prior art.

A variable capacity pump includes a control ring moveable within a pump chamber to alter the volumetric capacity of the pump. First and second control chambers individually receive pressurized fluid to create forces to bias the control ring in a predetermined direction. A return spring urges the control ring toward a maximum volumetric capacity pump position. The control ring connects and disconnects the second control chamber from a source of pressurized fluid based on a position of the control ring. Forces from the control chambers and the spring act in combination with one another or against one another and against the spring force to establish first and second equilibrium pressures based on a pressurized or vented condition of the second control chamber.

In a first arrangement, the return spring acts against the combined force of the two control chambers to establish a lower equilibrium pressure. After the control ring has moved a predetermined amount, a simple feature in the control ring is configured to close the hydraulic passage that energizes the second control chamber and opens a passage to vent the second control chamber. The return spring then acts against the force of only the first control chamber, to establish a second, higher equilibrium pressure.

In a second arrangement, the return spring acts against the force of a primary control chamber to establish a lower equilibrium pressure. After the control ring has moved a predetermined amount, a simple feature in the control ring is configured to open a hydraulic passage that energizes a second control chamber, acting against the force of the primary control chamber. The return spring and the force in the secondary control chamber then acts against the force in the first control chamber, and therefore establish a second, higher equilibrium pressure.

In a third arrangement, similar to the first one presented, a third chamber is added on the control ring and connected to the supply of working fluid by an ON/OFF Solenoid Valve to produce two relatively parallel pressure curves. A high mode is provided when the third chamber is not pressurized and a low mode when the third chamber is pressurized.

In a fourth arrangement, similar to the second one presented, a third chamber is added on the control ring and connected to the supply of working fluid by an ON/OFF Solenoid Valve to produce two relatively parallel pressure curves. A high mode is produced when the third chamber is not pressurized, and a low mode when the third chamber is pressurized.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DESCRIPTION

Figure 1:
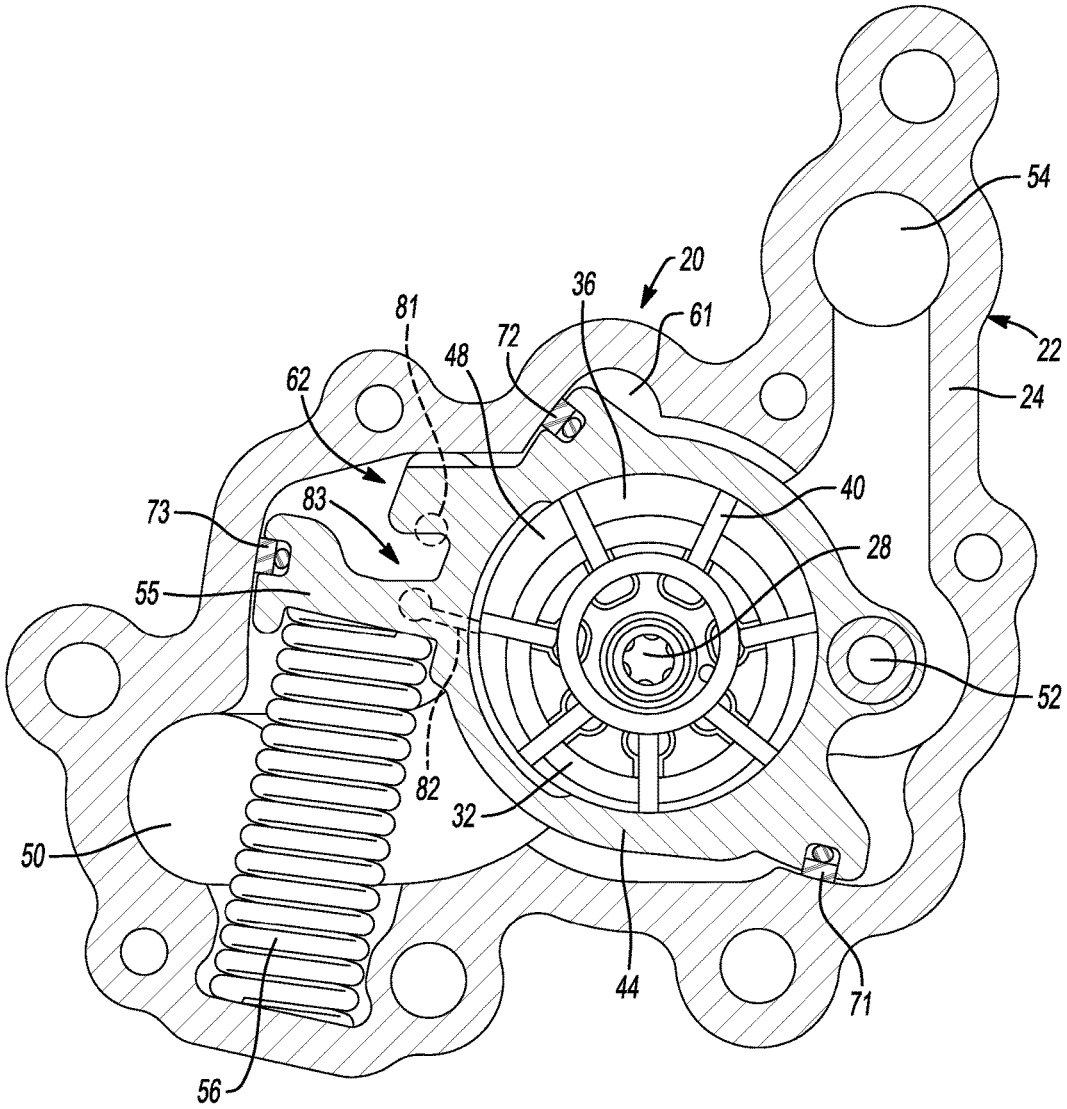
FIG. 1 is a partial plan view of a variable capacity pump constructed in accordance with the teachings of the present disclosure.
Figure 2A:
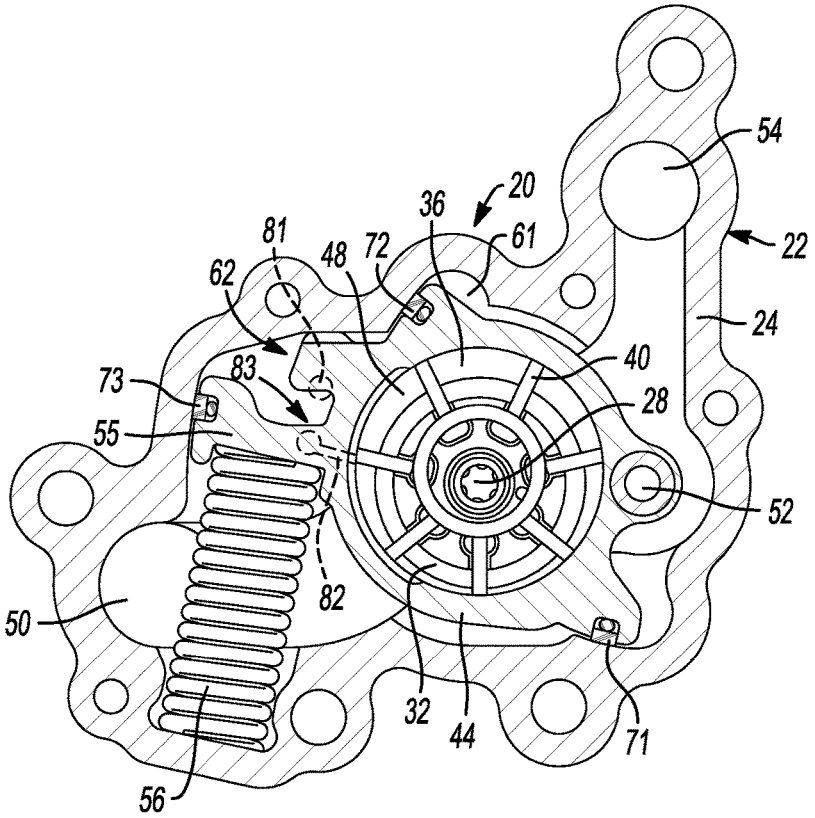
FIGS. 2A-2D show the pump at different eccentricity stages.
Figure 2B:
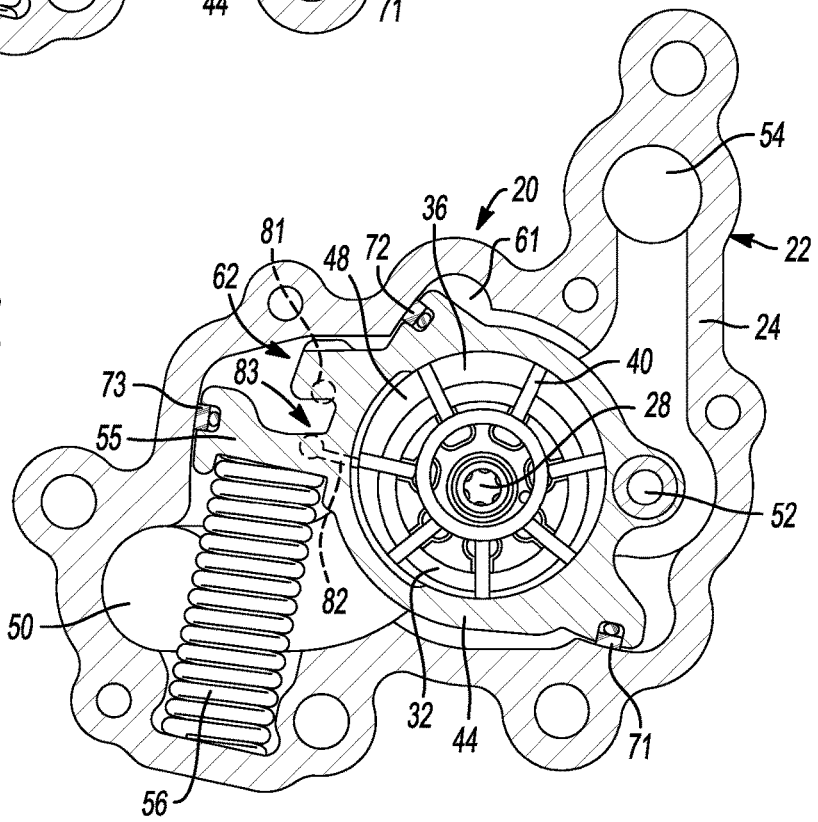
Figure 2C:
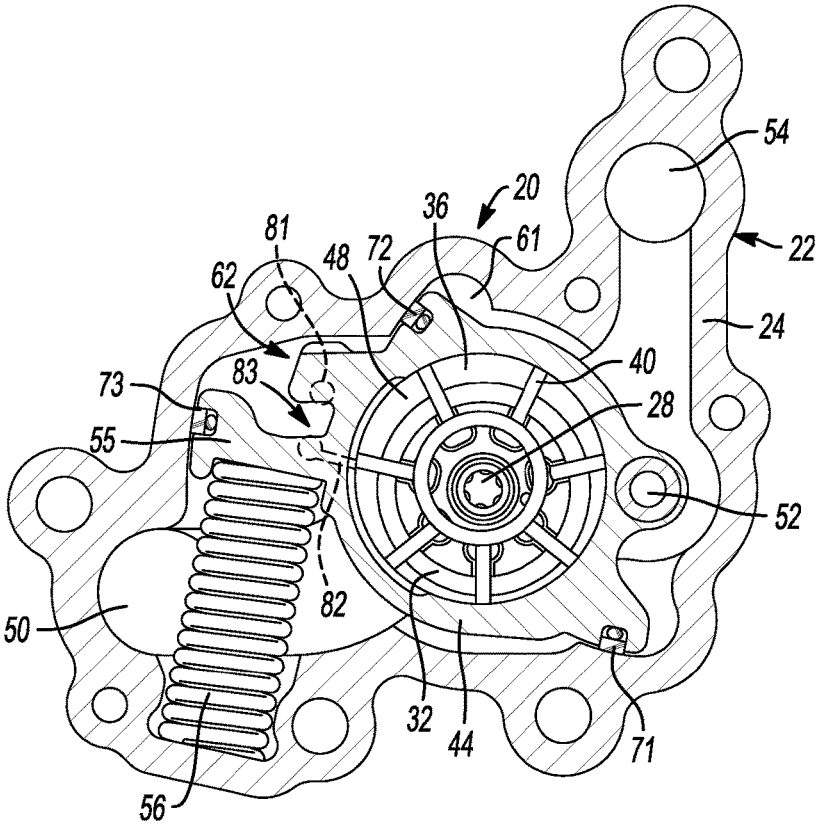
Figure 2D:
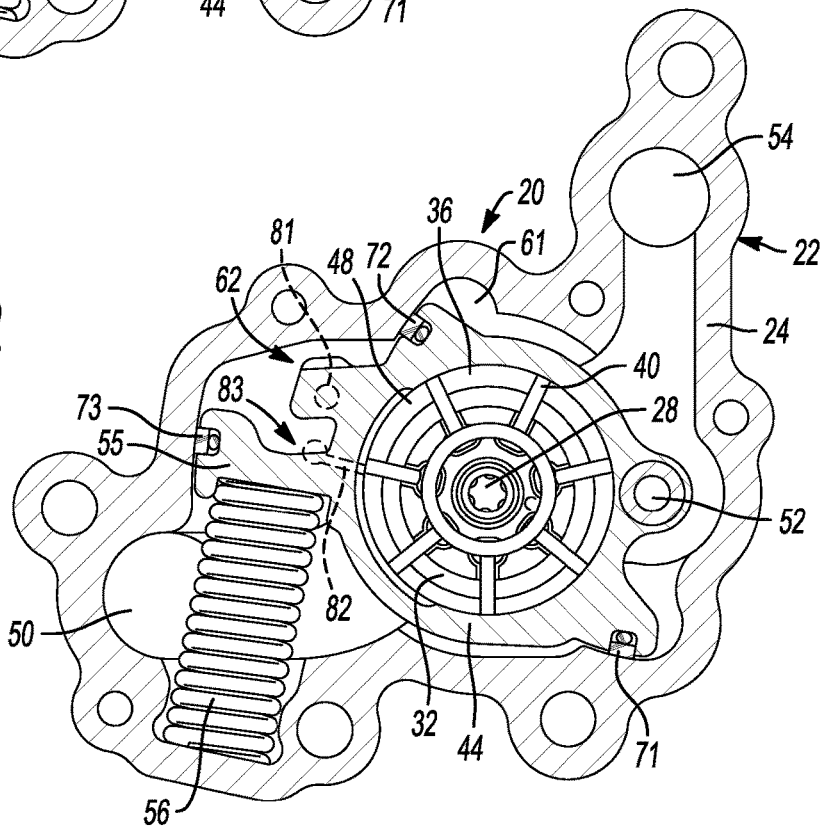

A variable capacity vane pump in accordance with an embodiment of the present invention is indicated generally at 20 in FIG. 1. Pump 20 includes a casing or housing 22 with a front face 24 which is sealed with a pump cover (not shown) and optionally a suitable gasket (not shown), to an engine (not shown) or the like, for which pump 20 is to supply pressurized working fluid.

Pump 20 includes a drive shaft 28 which is driven by any suitable means, such as the engine or other mechanism to which the pump is to supply working fluid, to operate pump 20. As drive shaft 28 is rotated, a pump rotor 32 located within a pump chamber 36 is driven by drive shaft 28. A series of slidable pump vanes 40 rotate with rotor 32, the outer end of each vane 40 engaging the inner circumferential surface of a pump control ring 44, which forms the outer wall of pump chamber 36. Pump chamber 36 is divided into a series of working fluid chambers 48, defined by the inner surface of pump control ring 44, pump rotor 32 and vanes 40.

Pump control ring 44 is mounted within housing 22 via a pivot pin 52 that allows the center of pump control ring 44 to be moved relative to the center of rotor 32. As the center of pump control ring 44 is located eccentrically with respect to the center of pump rotor 32 and each of the interior of pump control ring 44 and pump rotor 32 are circular in shape, the volume of working fluid chambers 48 changes as the chambers 48 rotate around pump chamber 36, with their volume becoming larger at the low pressure side (the left hand side of pump chamber 36 in FIG. 1) of pump 20, and smaller at the high pressure side (the right hand side of pump chamber 36 in FIGS. 2A-2D) of pump 20. This change in volume of working fluid chambers 48 generates the pumping action of pump 20, drawing working fluid from a pump inlet 50 and pressurizing and delivering it to a pump outlet 54.

By moving pump control ring 44 about pivot pin 52 the amount of eccentricity, relative to pump rotor 32, can be changed to vary the amount by which the volume of working fluid chambers 48 change from the low pressure side of pump 20 to the high pressure side of pump 20, thus changing the volumetric capacity of the pump. A return spring 56 engages a tab 55 of control ring 44 and housing 22 to bias pump control ring 44 to the position, shown in FIG. 1, wherein the pump has a maximum eccentricity.

A first control chamber 61 is formed between pump housing 22, pump control ring 44, a seal 71 and a seal 72, mounted on pump control ring 44 and abutting housing 22. In the illustrated configuration, first control chamber 61 is in direct fluid communication with pump outlet 54 such that pressurized working fluid from pump 20 which is supplied to pump outlet 54 also fills first control chamber 61.

As will be apparent to those of skill in the art, first control chamber 61 need not be in direct fluid communication with pump outlet 54 and can instead be supplied from any suitable source of working fluid, directly or indirectly, such as from oil gallery in an automotive engine being supplied by pump 20.

A second control chamber 62 is formed between pump housing 22, pump control ring 44, seal 72 and a seal 73, mounted on pump control ring 44 and abutting housing 22.

Figure 3:
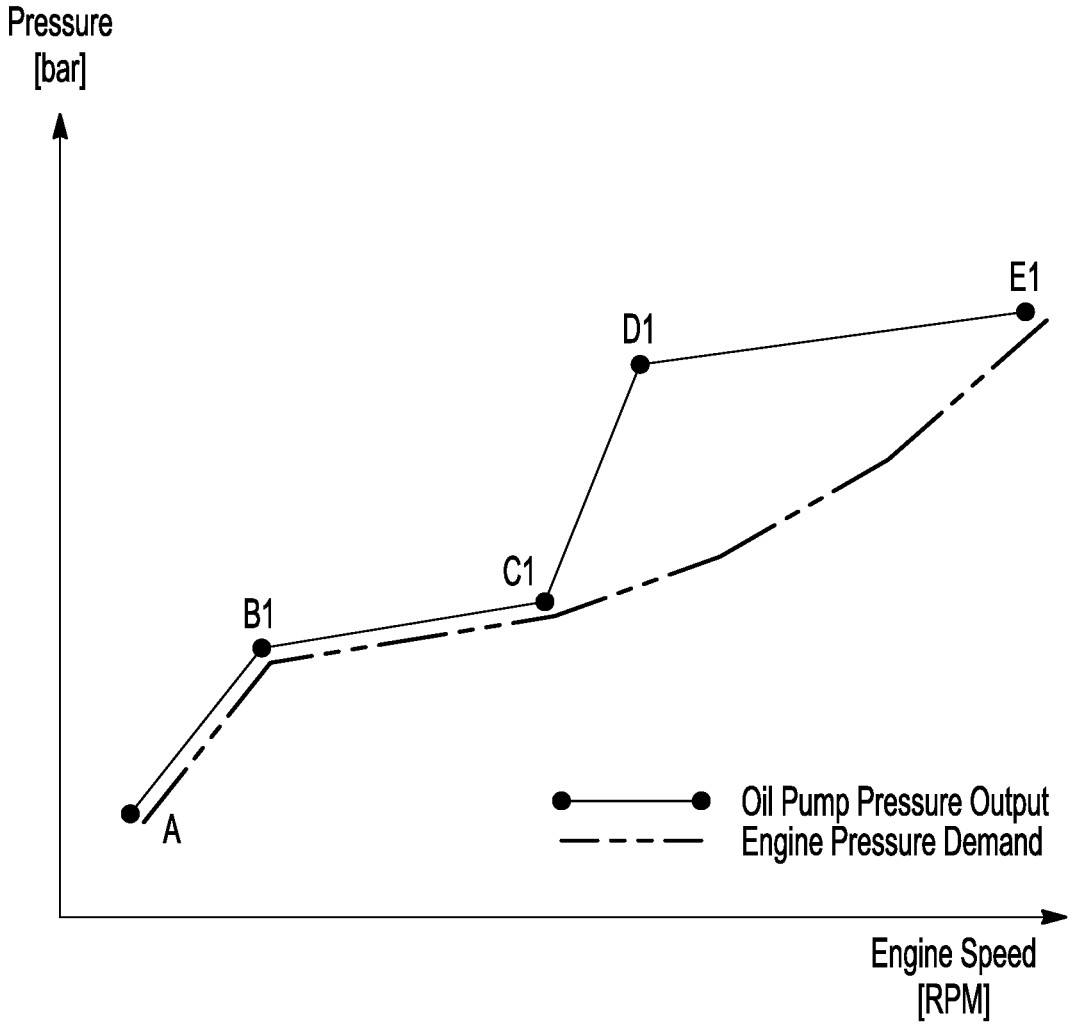
FIG. 3 is a graph of the pressure output of the pump depicted in FIGS. 2A-2D versus the oil pressure demand of the mechanical system.

Second control chamber 62 is supplied with pressurized fluid via a feeding orifice 81 into the housing 22, and located partially under the pump control ring 44. Pressurized fluid for orifice 81 can be supplied either from pump outlet 54, or other source of working fluid, such as an oil gallery in an automotive engine. A discharge passage 82 is located in the housing 22 and under the pump control ring 44 in communication with the pump inlet 50. A channel or recess 83 extends across the width of control ring 44 in a direction perpendicular to a direction that the control ring moves. As shown in FIGS. 2A-2D, feeding orifice 81, discharge passage 82 and recess 83 are positioned and sized to create a pump pressure output versus speed as shown in FIG. 3. There are four distinctive steps, shown in FIGS. 2A-2D, that generate the pump pressure output curve.

In curve portion A-B1, both first control chamber 61 and second control chamber 62 are energized because the feeding orifice 81 is connected to second control chamber 62 and the discharge passage 82 is not connected, being completely covered by the pump control ring 44. However, at low pump operating speeds, the force and consequently the turning moment around the pivot pin 52 created by the pressure build up in the two control chambers is insufficient to counter the force of the return spring 56, and as such the pump remains at maximum eccentricity.

In curve portion B1-C1, the pressure build up due to higher speeds of the pump has generated enough force, from the pressure in the two control chambers and consequently the turning moment, acting around the pivot pin 52 to exceed the force of the return spring 56, which is providing an opposing turning moment acting around the pin to reduce the pump control ring eccentricity. In this phase, the slight movement of the control ring 44 has not yet opened the discharge passage 82 to second control chamber 62, hence both control chambers are still working.

Curve portion C1-D1 represents a transition phase, where the movement of the pump control ring started in portion B1-C1 has reached a point where the recess 83 is changing second control chamber 62 connections. Pressure feeding orifice 81 is closed and discharge passage 82 is opened, ultimately venting second control chamber 62. As such, with a further increase in operating speed and pressures, only first control chamber 61 is energized and a new force balance is established around pivot pin 52. The pressure from first control chamber 61 acts against the force generated by the return spring 56. In this phase, the slight pressure increase in first control chamber 61 cannot move the control ring 44 and the pump eccentricity remains essentially constant.

In curve portion D1-E1, the pressure within first control chamber 61 increases due to higher pump operating speeds to generate enough force from the pressure in the first control chamber 61, acting as a turning moment, around the pivot pin 52 to exceed the force of the return spring 56, which is providing an opposing turning moment around the pin. A reduction of the pump control eccentricity occurs.

Figure 4:
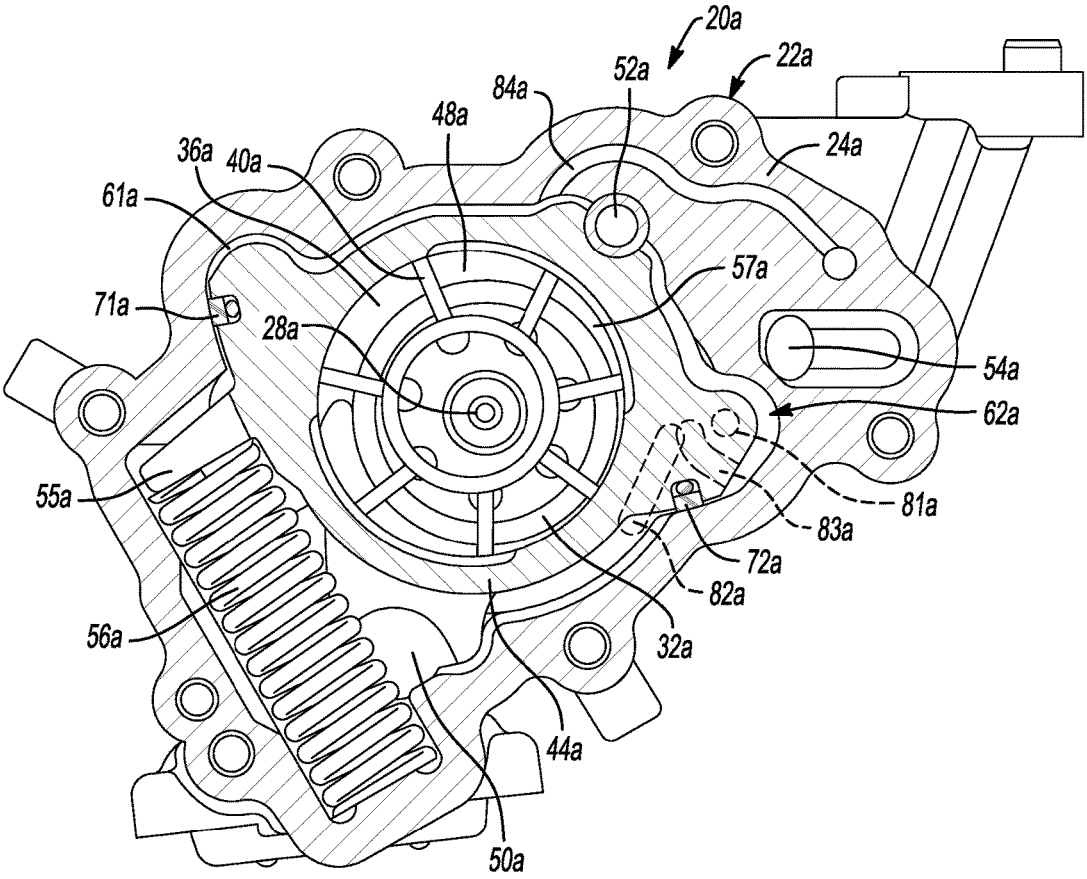
FIG. 4 is a partial plan view of another variable capacity pump.
Figure 5A:
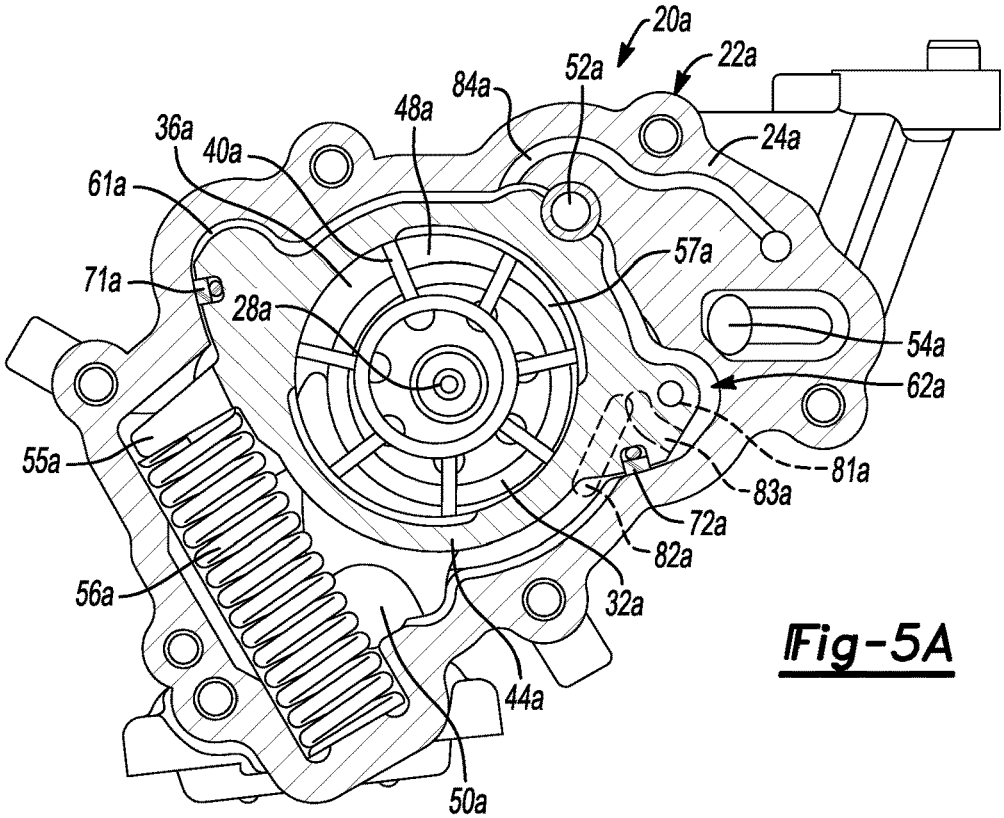
FIGS. 5A-5D show the pump of FIG. 4 different eccentricity stages.
Figure 5B:
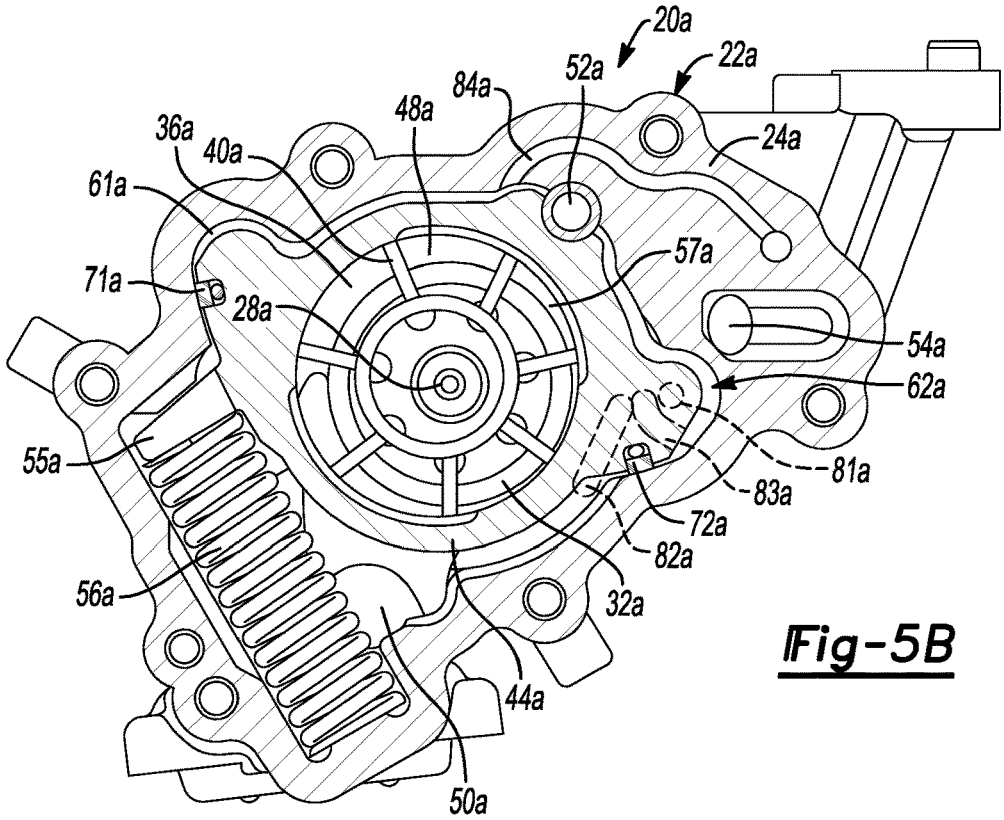
Figure 5C:
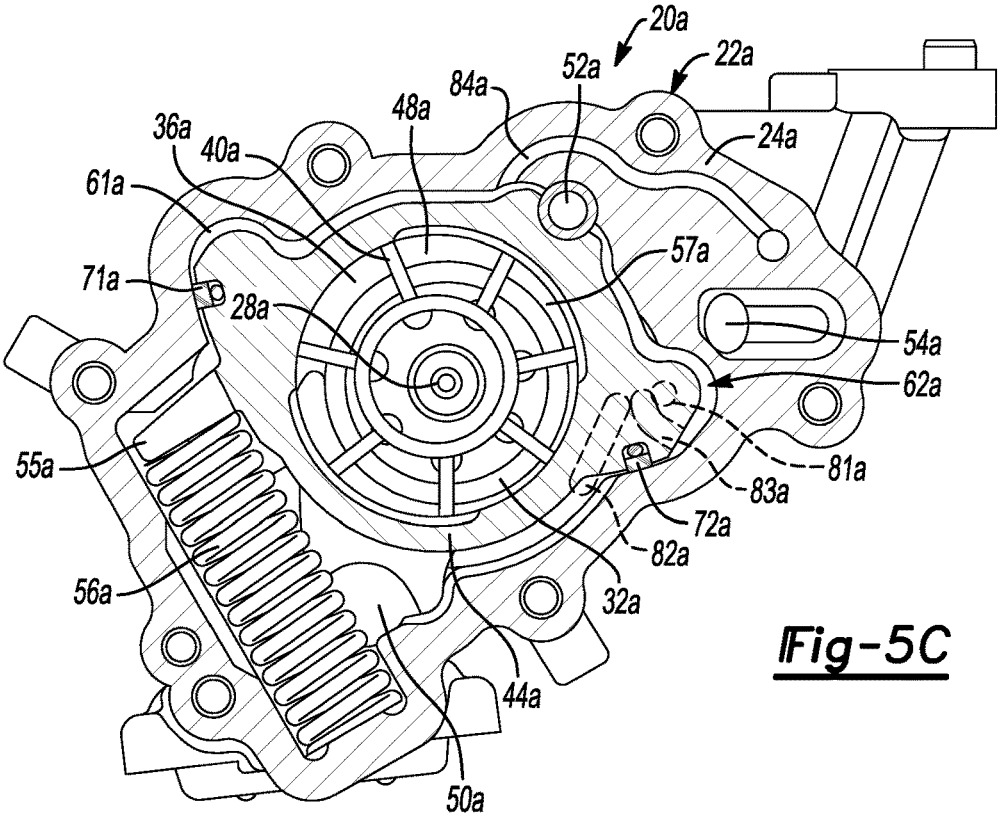
Figure 5D:
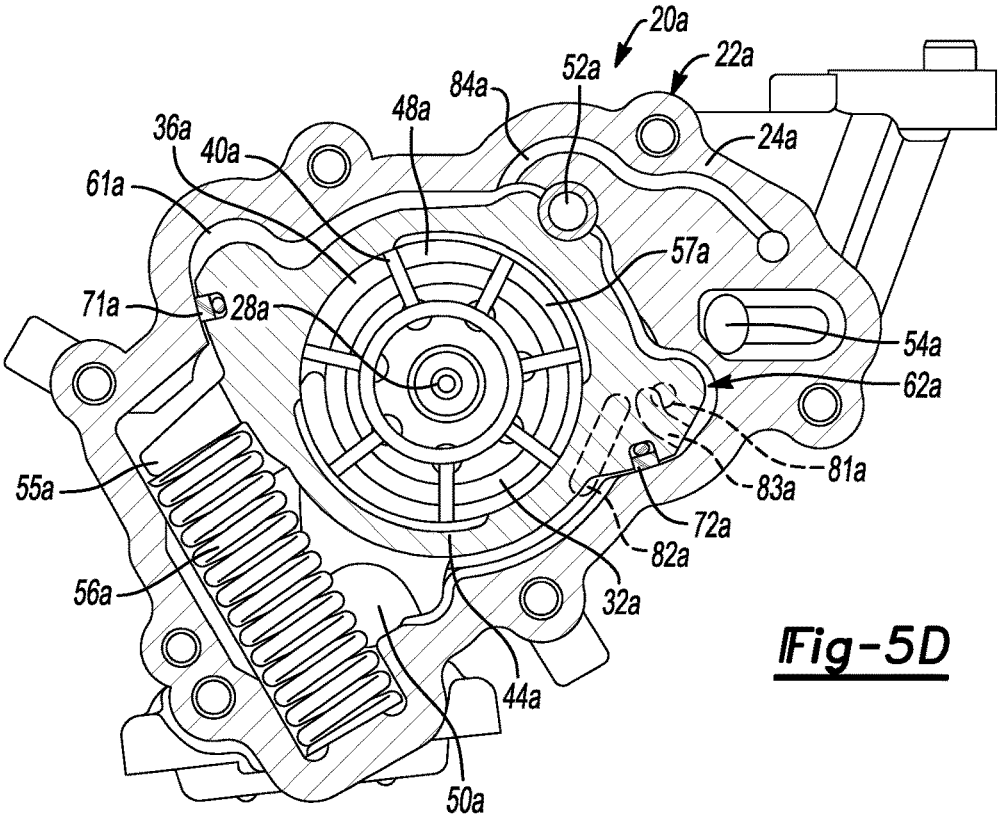

Another pump constructed according to the principles of the present disclosure is shown in FIG. 4 and identified at reference number 20*a*. Pump 20*a* includes similar components to pump 20. Similar elements will be identified by like numerals including an "a" suffix. In this arrangement, two control chambers are located on opposite sides of the pivot pin 52*a*, and act against each other. The pump outlet 54*a* is connected to a pressure port 57*a* via a drilled internal channel within the housing 22*a*. In this arrangement, a first control chamber 61*a* is formed in the pump chamber 36*a*, between pump control ring 44*a*, pump housing 22*a*, seal 71*a* and pivot pin 52*a*, and when energized, it creates a force, acting as a turning moment around pivot pin 52*a*, opposite to the force of the return spring 56*a*. In the illustrated configuration, first control chamber 61*a* is supplied with pressurized fluid from engine oil gallery or pump outlet via a feeding channel 84*a*.

A second control chamber 62*a* is formed in the pump chamber 36*a*, between pump control ring 44*a*, pump housing 22*a*, seal 72*a* and pivot pin 52*a*, and when energized, it creates a force, acting as a turning moment, around pivot pin 52*a*, acting in the same direction as the force of the return spring 56*a*.

Second control chamber 62*a* is supplied with pressurized fluid via a feeding orifice 81*a* into the housing 22*a*, and located under the pump control ring 44*a*. Pressurized fluid for orifice 81*a* can be supplied either from pump outlet 54*a*, or other source of working fluid, directly or indirectly, such as an oil gallery in an automotive engine. A discharge passage 82*a* located in the housing 22*a* and partially under the pump control ring 44*a*, is in connection to the pump inlet 50*a*. A channel 83*a* is shaped as a blind recess having an opening at an edge of control ring 44*a* that extends along a surface of the control ring that slides relative to pump housing 22. As shown in FIGS. 5A-5D, pump 20*a* is equipped with feeding orifice 81*a*, discharge passage 82*a*, and connecting channel 83*a* in pump control ring 44*a* to create a pump pressure output as shown in FIG. 3. There are four distinctive steps, shown in FIGS. 5A-5D, that generate that pump pressure output curve.

In curve portion A-B1, first control chamber 61*a* is energized via feeding channel 84*a* and second control chamber 62*a* is not energized, since second control chamber 62*a* is vented to the inlet via discharge passage 82*a* and the connecting channel 83*a*. The feeding orifice 81*a* is not connected to second control chamber 62*a*, being completely covered by the pump control ring 44*a*. At low pump operating speeds, the force, acting as a turning moment, around the pivot pin 52*a* created by the pressure build up in first control chamber 61*a* is not sufficient to counter the force created by the return spring 56*a*, and as such the pump remains at maximum eccentricity.

At curve portion B1-C1, the pressure build up due to higher operating speeds of the pump has generated enough force from first control chamber 61*a*, acting as a turning moment, around the pivot pin 52*a* to exceed the force of the return spring 56*a*, acting as an opposing turning moment, around the pin, determining a reduction of the pump eccentricity. In this phase, the slight movement of control ring 44*a* has not yet connected the feeding orifice 81*a* to the connecting channel 83*a*, hence only first control chamber 61*a* is still working.

Curve portion C1-D1 represents a transition phase, where the movement of the pump control ring started in portion B1-C1 has reached a point where the control channel 83*a* is changing second control chamber 62*a* connections, by connecting pressure feeding orifice 81*a* with second control chamber 62*a* and closing the second control chamber 62*a* connection to discharge passage 82*a*. As such, with further increase in pump operating speed and pressures, both control chambers 61*a* and 62*a* are energized and a new force balance is established around pivot pin 52*a*. The pressure from first control chamber 61*a* acts against the force generated by the return spring 56*a* and second control chamber 62*a*.

At curve portion D1-E1, the pressure build up due to higher operating speeds of the pump has generated enough force from first control chamber 61*a*, acting as a turning moment, around the pivot pin 52*a* to exceed the force of the return spring 56*a* combined with the force from second control chamber 62*a*, determining a reduction of the pump eccentricity.

It should be appreciated that the feeding orifice 81, discharge passage 82, and recess 83 described in relation to pump 20 and depicted in FIG. 1 may alternatively be applied to pump 20*a* in lieu of feeding orifice 81*a*, discharge passage 82*a* and recess 83*a*. It is also contemplated that the geometry incorporated to provide the passive control features of pump 20*a* may be applied to pump 20.

Figure 6:
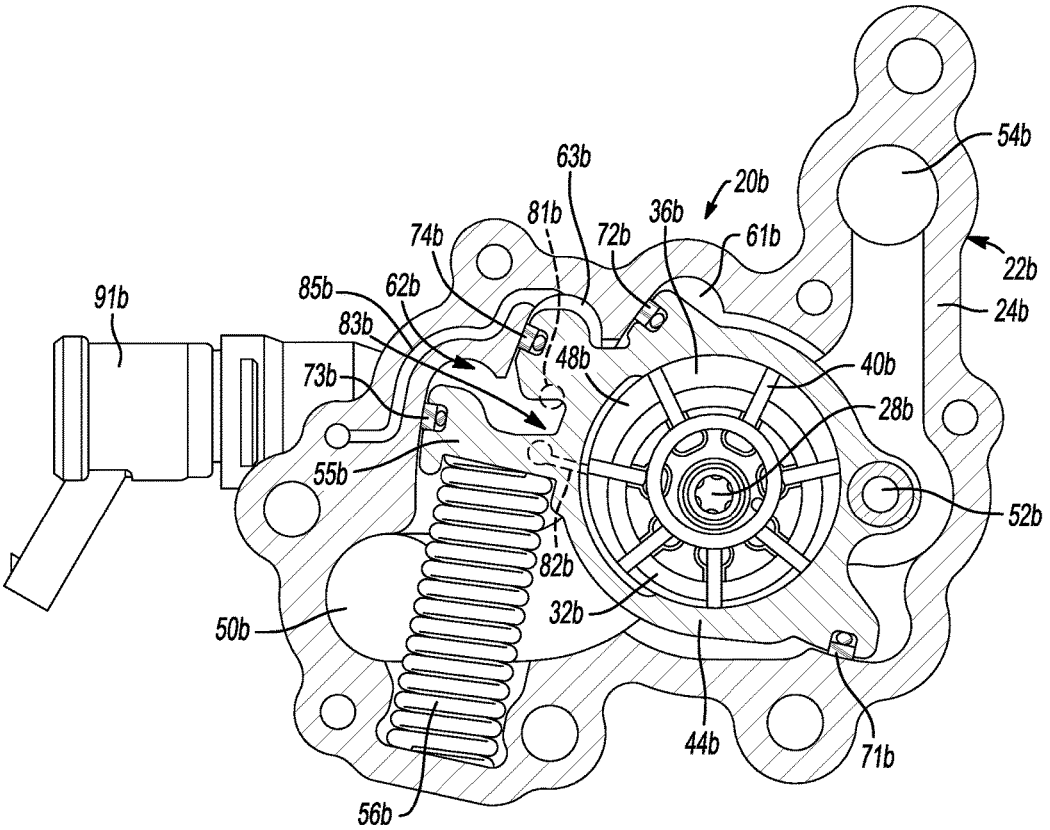
FIG. 6 is a partial plan view of another variable capacity pump.
Figure 7A:
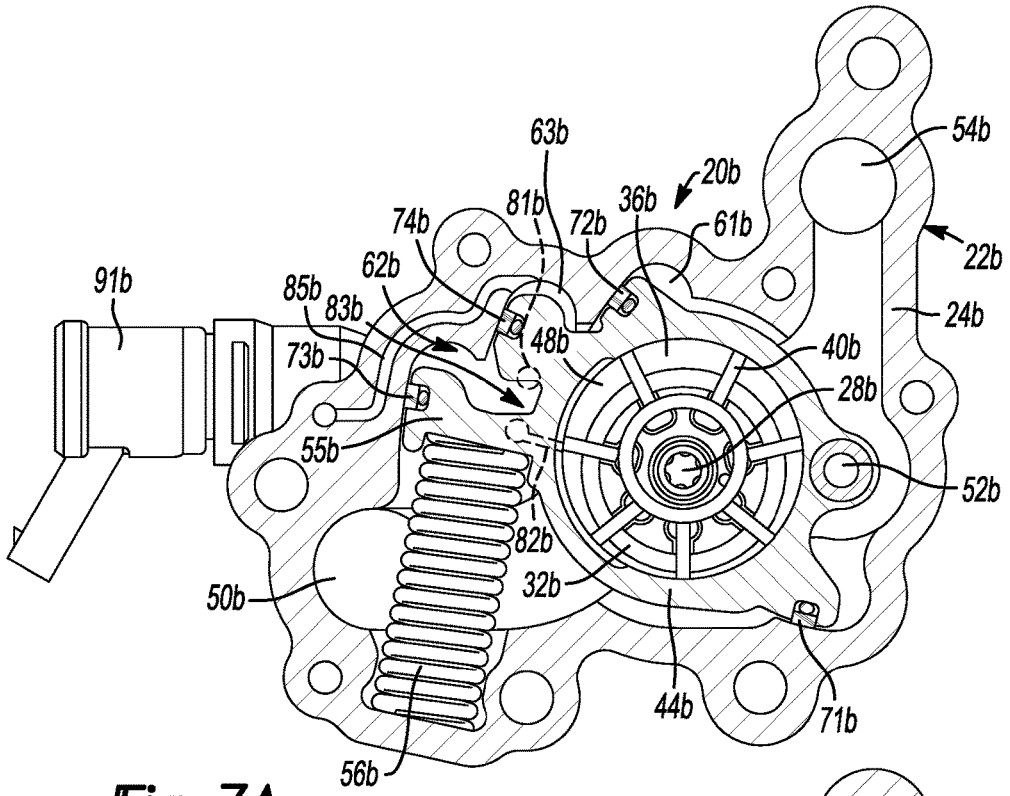
FIGS. 7A-7D show the pump of FIG. 6 at different eccentricity stages.
Figure 7B:
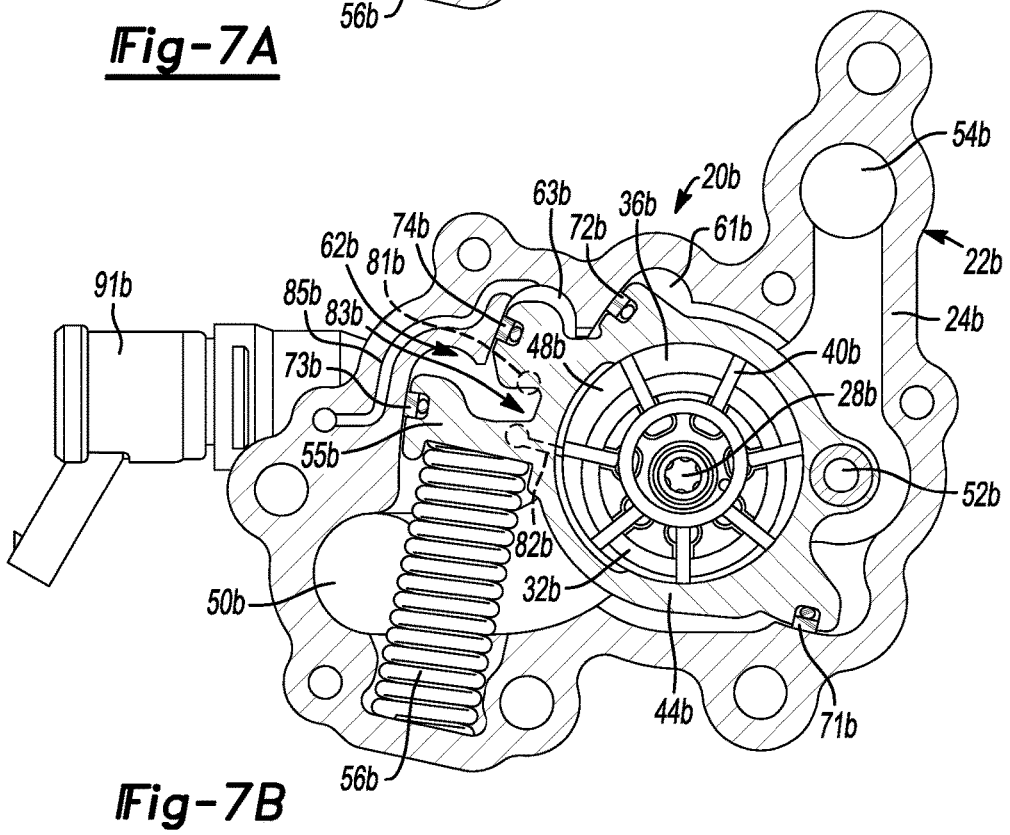
Figure 7C:
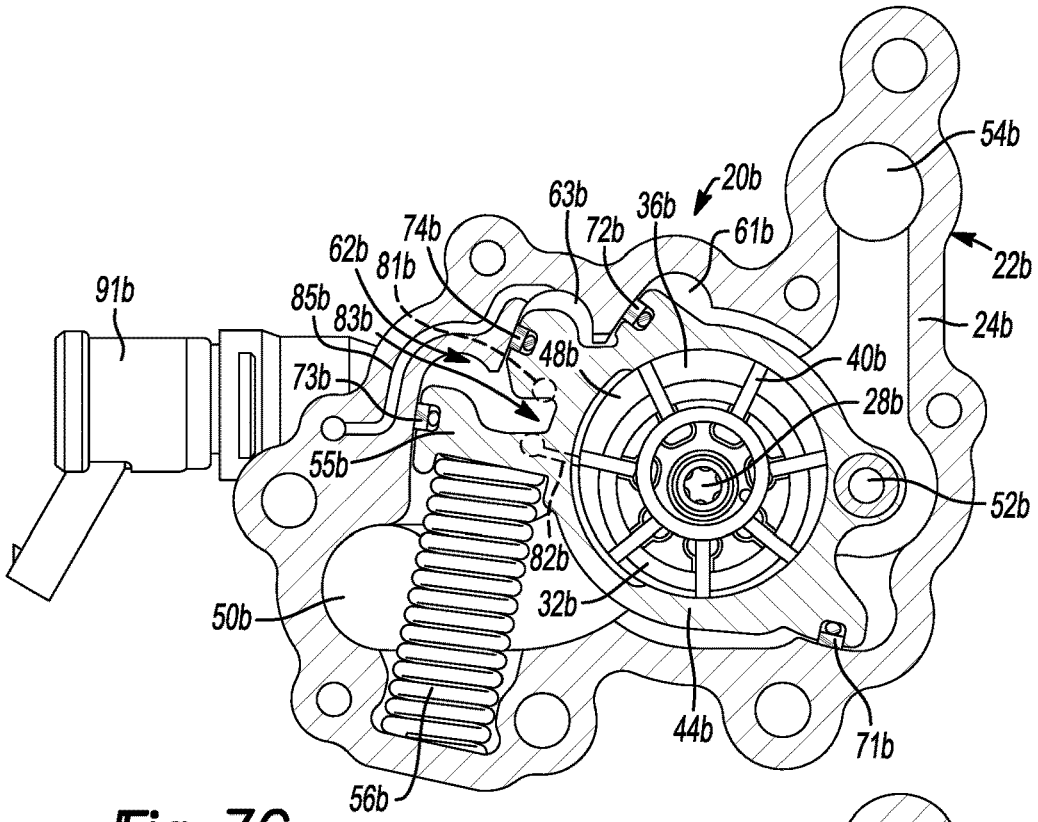
Figure 7D:
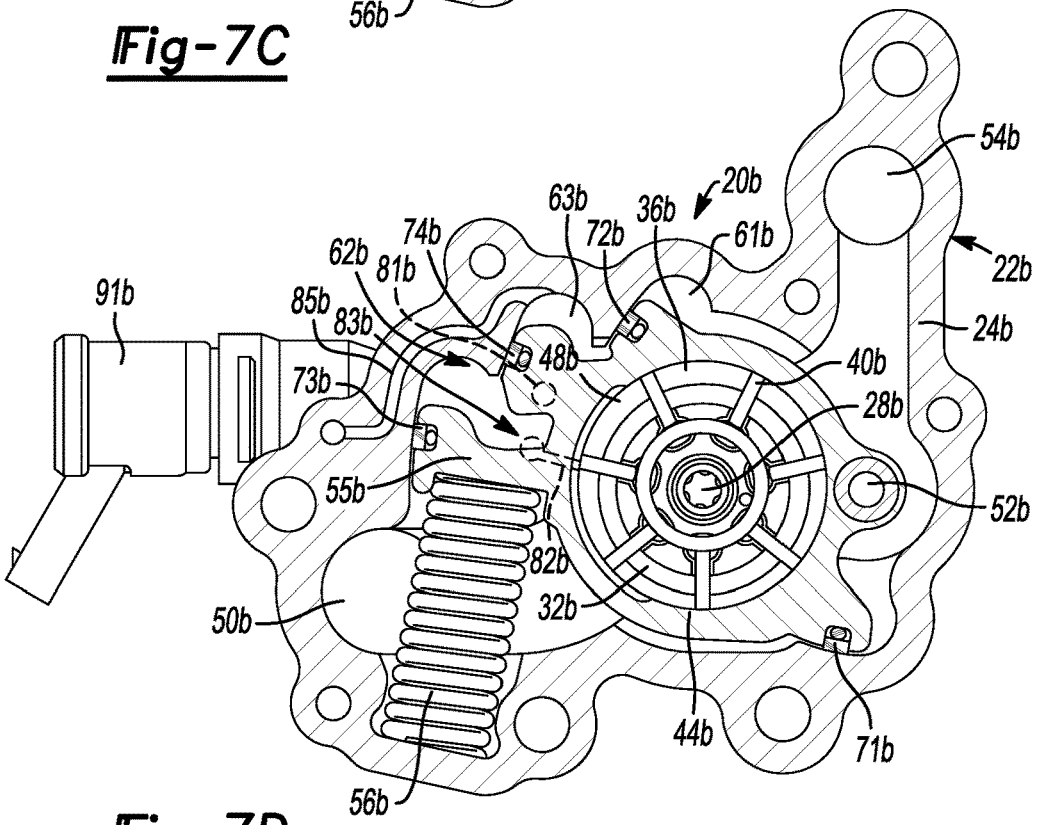
Figure 8:
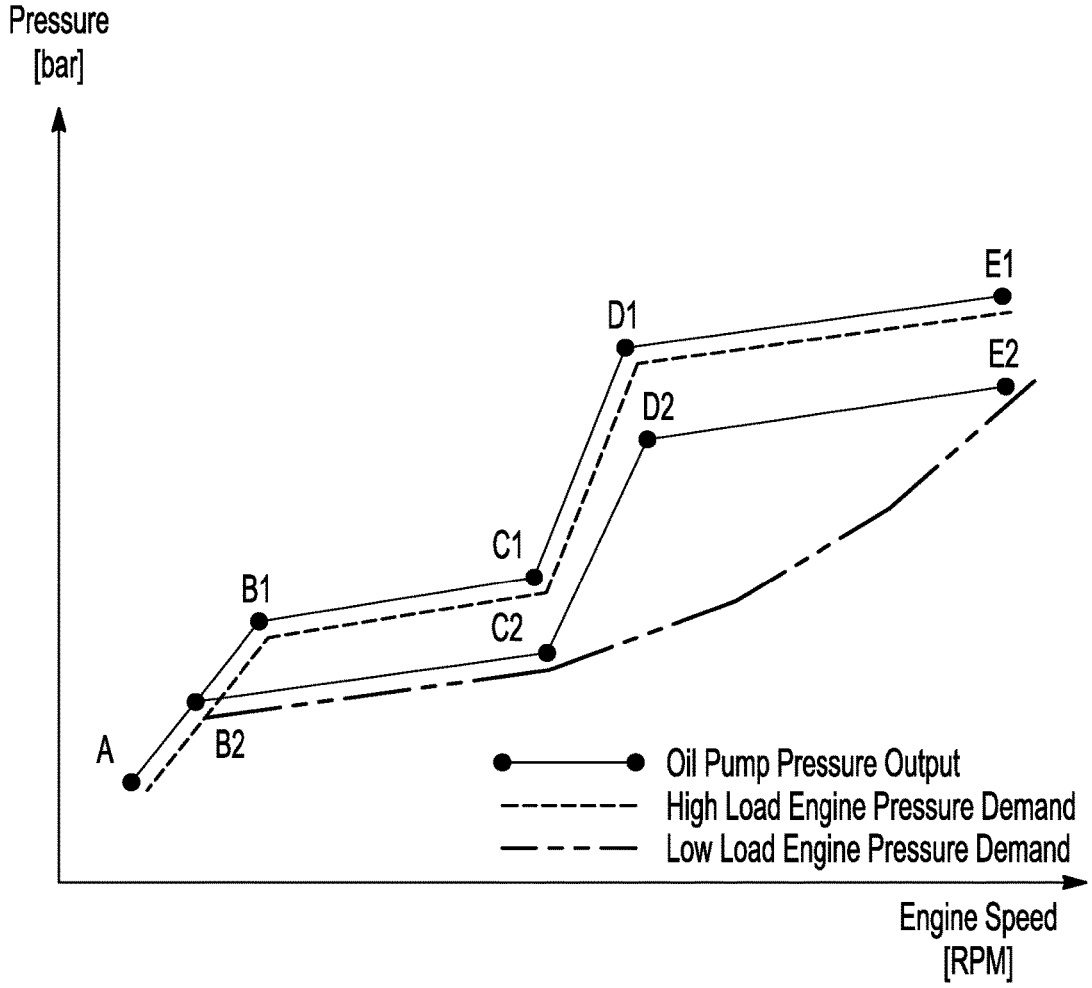
FIG. 8 is a graph of the pressure output of the pump shown in FIGS. 7A-7D versus the minimum and maximum oil pressure demand of a mechanical system.

Another alternate variable capacity pump is presented in FIG. 6 and identified as reference number 20*b*. Pump 20*b* is substantially similar to pump 20 shown in FIG. 1, to which a third control chamber 63*b* connected to an electrically controlled hydraulic solenoid valve 91*b* was added. Similar features will be identified with like numerals including a "b" suffix. Use of the third control chamber 63*b* provides the flexibility to generate either a high (A-B1-C1-D1-E1) or a low (A-B2-C2-D2-E2) pump pressure output in relation to operating speed as shown in FIG. 8. It may be beneficial to provide a pump operable to meet different demand requirements that may occur during the operation on an automobile engine. For example, many newer vehicles are selectively operable in a high load engine pressure demand mode, as well as the more traditional low load engine pressure demand mode. A pressure output may be required from the pump to provide lubricating and cooling oil to an auxiliary system such as an internal combustion engine piston cooling system. The high load engine pressure demand curve in FIG. 8 may include a greater inflection in the pressure versus engine speed curve at a predetermined engine speed. One skilled in the art should appreciate that the present configuration of pump 20*b* equipped with third control chamber 63*b* and solenoid valve 91*b* provides a simple and cost effective solution to the requirement for substantially different pressure demand curves. In particular, it is contemplated that electrically controlled hydraulic solenoid valve 91*b* is an inexpensive on/off valve. It should also be appreciated that if greater control is required, the electrically controlled solenoid valve may be a proportional type operable to modulate the pressure in third control chamber 63*b* between the system pressure and either atmospheric pressure or pump inlet pressure.

As presented in FIG. 6, first control chamber 61*b* is formed between pump housing 22*b*, pump control ring 44*b*, seal 71*b* and seal 72*b*, mounted on pump control ring 44*b* and abutting housing 22*b*. In the illustrated configuration, first control chamber 61*b* is in direct fluid communication with pump outlet 54*b* such that pressurized working fluid from pump 20*b* which is supplied to pump outlet 54*b* also fills first control chamber 61*b*.

As will be apparent to those skilled in the art, first control chamber 61*b* need not be in direct fluid communication with pump outlet 54*b* and can instead be supplied from any suitable source of working fluid, directly or indirectly, such as from an oil gallery in an automotive engine being supplied by pump 20*b*.

Second control chamber 62*b* is formed between pump housing 22*b*, pump control ring 44*b*, seal 73*b* and seal 74*b*, mounted on pump control ring 44*b* and abutting housing 22*b*. Second control chamber 62*b* is supplied with pressurized fluid via a feeding orifice 81*b* into the housing 22*b*, and located partially under the pump control ring 44*b*. Pressurized fluid for orifice 81*b* can be supplied either from pump outlet 54*b*, or other source of working fluid, such as an oil gallery in an automotive engine. A discharge passage 82*b* located into the housing 22*b* and under the pump control ring 44*b*, is in connection to the pump inlet 50*b*.

Third control chamber 63*b* is formed between pump housing 22*b*, pump control ring 44*b*, seal 72*b* and seal 74*b* and is supplied in pressurized oil from the solenoid valve 91*b* via a feeding channel 85*b*. As shown in FIGS. 7A-7D, pump 20*b* includes feeding orifice 81*b*, discharge passage 82*b* and recess 83*b* in the pump control ring 44*b*, designed and sized to create a pump pressure output as shown in FIG. 8. When third control chamber 63*b* is not energized with pressurized working fluid from the solenoid valve, the pump works in high mode, and generates the pressure curve A-B1-C1-D1-E1 as shown in FIG. 8. There are four steps, shown in FIGS. 7A-7D, that generate the high mode pump pressure output curve.

In curve portion A-B1, both first control chamber 61*b* and second control chamber 62*b* are energized, because the feeding orifice 81*b* is connected to second control chamber 62*b* and the discharge passage 82*b* is not connected, being completely covered by the pump control ring 44*b*. At low pump operating speeds, the force, acting as a turning moment, around the pivot pin 52*b* created by the pressure build up in control chambers 61*b*, 62*b* is not sufficient to counter the force created by the return spring 56*b*, which is acting around the pin as an opposing turning moment, and as such the pump remains at maximum eccentricity.

In curve portion B1-C1, the counter pressure build up due to higher operating speeds of the pump has generated enough force from the two control chambers, acting as a turning moment, around the pivot pin 52*b* to exceed the force of the return spring 56*b*, acting as an opposing turning moment, around the pin to reduce of the pump eccentricity. In this phase, the slight movement of the control ring 44*b* has not yet opened the discharge passage 82*b* to second control chamber 62*b*, hence both control chambers are still working.

Curve portion C1-D1 represents a transition phase, where the movement of the pump control ring started in portion B1-C1 has reached a point where the recess 83*b* is changing second control chamber 62*b* connections, by closing its pressure feeding orifice 81*b* and opening the discharge passage 82*b*, ultimately venting second control chamber 62*b*. As such, with a further increase in pump operating speed, system pressure and feeding pressures, only first control chamber 61*b* is energized and a new force balance is established around pivot pin 52*b*, the pressure from first control chamber 61*b* acting against the force generated by the return spring 56*b*.

At curve portion D1-E1, the pressure due to higher operating speeds of the pump has generated enough force from first control chamber 61*b*, acting around the pivot pin 52*b* to exceed the force of the return spring 56*b* acting around the pin, causing a reduction of the pump eccentricity.

Pressure curve A-B2-C2-D2-E2 is generated in a similar fashion with the exception that solenoid valve 91*b* is energized to provide pressurized fluid to third control chamber 63*b* via feeding channel 85*b*. A force acting in an opposite direction to the spring force is applied when third control chamber 63*b* is pressurized. As such, the eccentricity of control ring 44*b* is reduced. An offset, low pressure output curve results.

Figure 9:
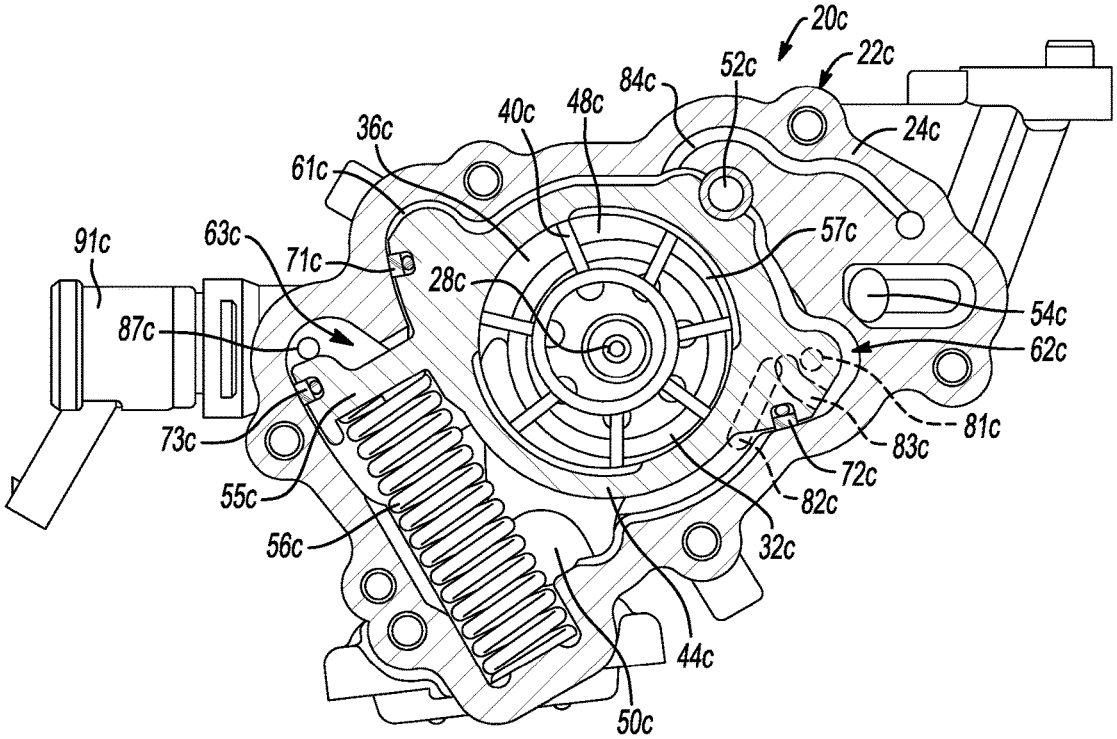
FIG. 9 is a partial plan view of another variable capacity pump.
Figure 10A:
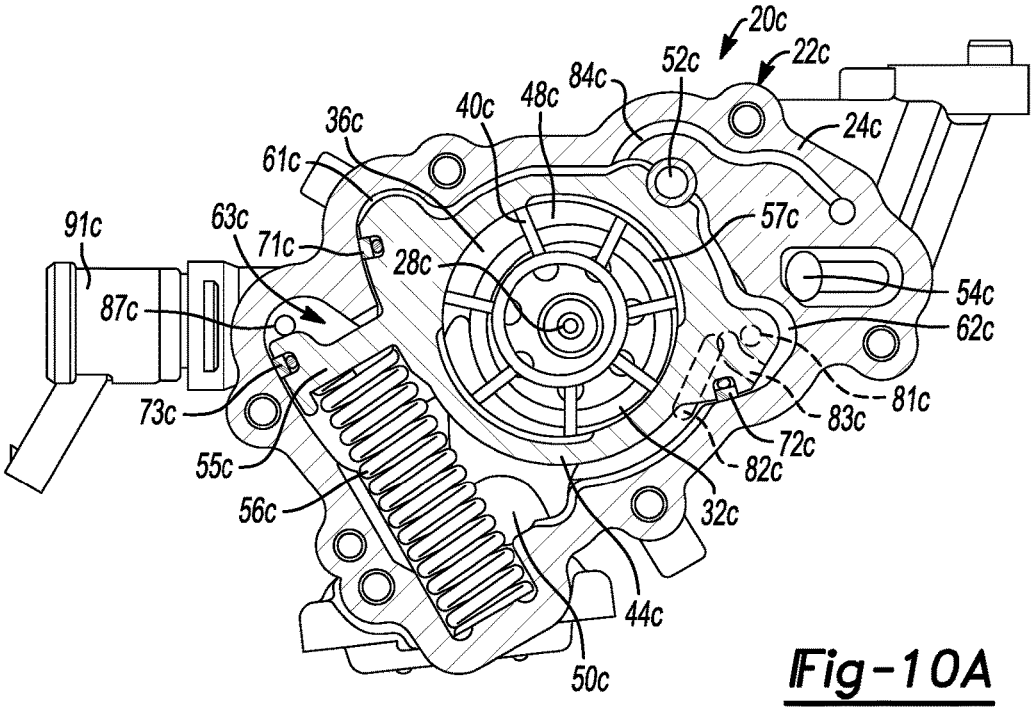
FIGS. 10A-10D show the pump of FIG. 9 at different eccentricity stages.
Figure 10B:
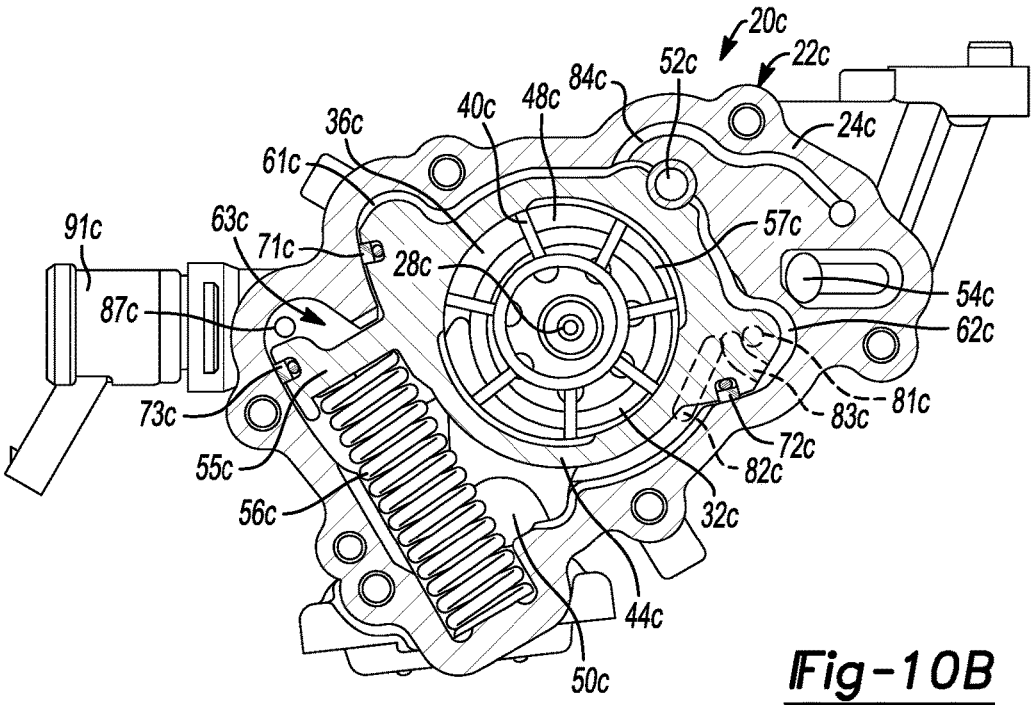
Figure 10C:
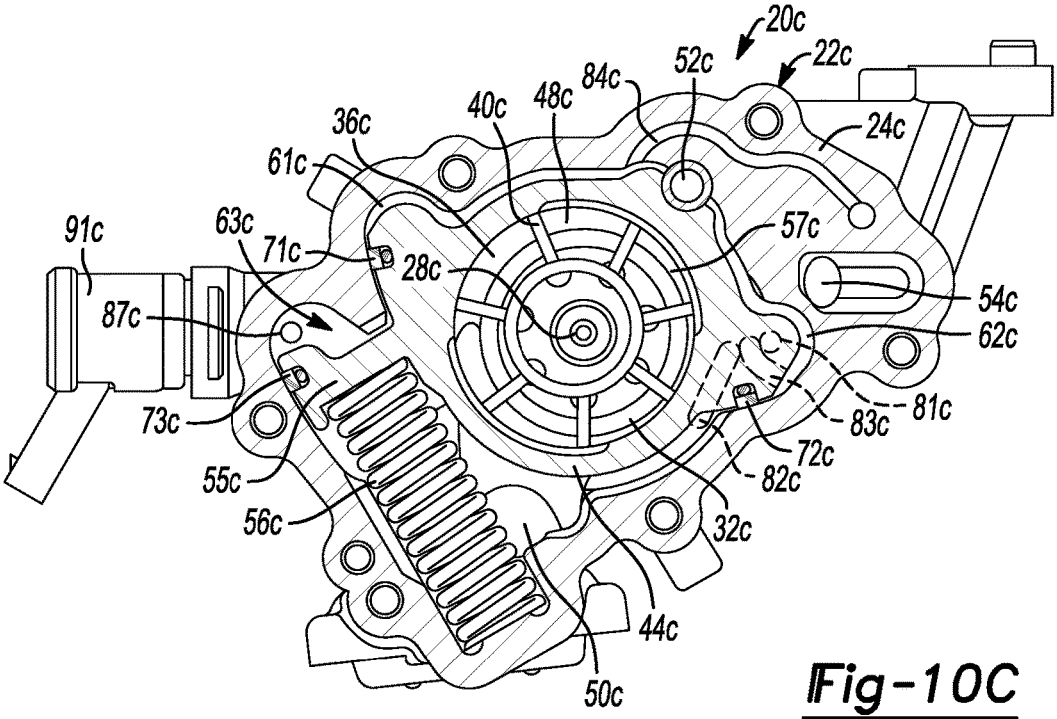
Figure 10D:
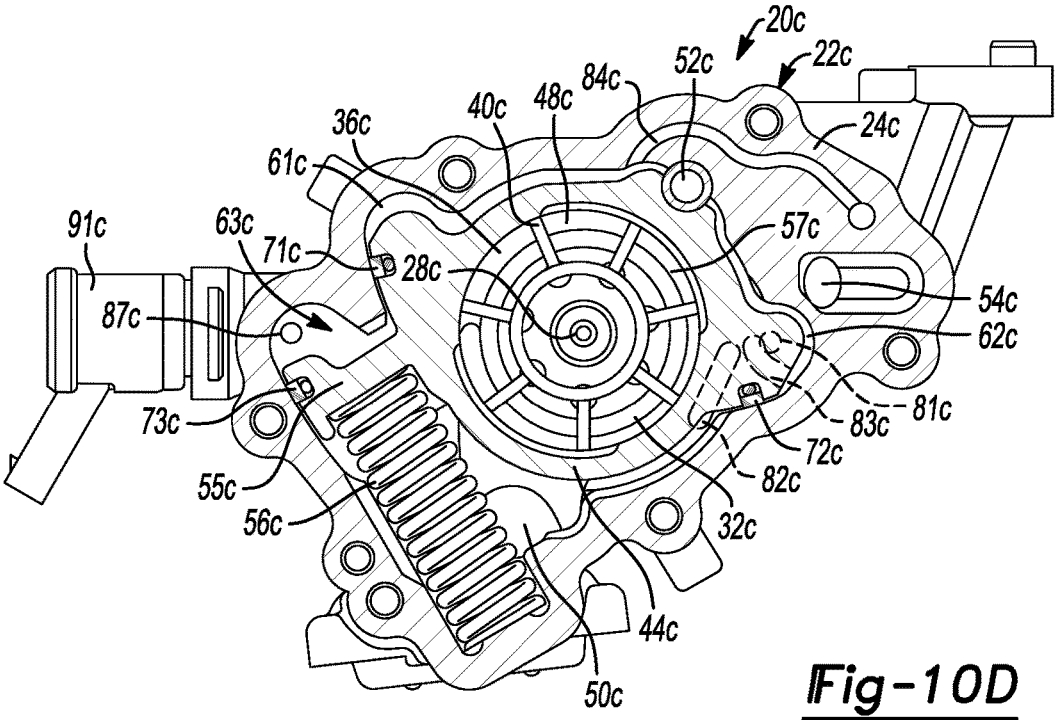

Another variable capacity pump 20*c* is depicted in FIG. 9. Pump 20*c* is substantially similar to pump 20*a* with the exception that a third control chamber 63*c* connected to an electrically controlled hydraulic solenoid valve 91*c* are included. Similar features will be identified with like numerals including a "c" suffix. Control of valve 91*c* allows pump 20*c* to generate either the high (A-B1-C1-D1-E1) or low (A-B2-C2-D2-E2) pump pressure output in relation to operating speed. As presented in FIG. 9, two control chambers are located on one side of the pivot pin 52*c*, while a third control chamber and the return spring 56*c* are on an opposite side of the pivot. The pump outlet 54*c* is connected to the pressure port 57*c* via a drilled internal channel within the housing 22*c*. Pump 20*c* includes first control chamber 61*c* formed in the pump chamber 36*c*, between pump control ring 44*c*, pump housing 22*c*, seal 71*c* and pivot pin 52*c*, and when energized, it creates a force, acting as a turning moment around pivot pin 52*c*, opposite to the force of the return spring 56*c*. In the illustrated configuration, first control chamber 61*c* is supplied with pressurized fluid from engine oil gallery or pump outlet via a feeding channel 84*c*.

A second control chamber 62*c* is formed in the pump chamber 36*c*, between pump control ring 44*c*, pump housing 22*c*, seal 72*c* and pivot pin 52*c*, and when energized, it creates a force, acting as a turning moment, around pivot pin 52*c*, acting in the same direction as the momentum created by the force of the return spring 56*c*.

Second control chamber 62*c* is supplied with pressurized fluid via a feeding orifice 81*c* into the housing 22*c*, and located under the pump control ring 44*c*. Pressurized fluid for orifice 81*c* can be supplied either from pump outlet 54*c*, or other source of working fluid, directly or indirectly, such as an oil gallery in an automotive engine. A discharge passage 82*c* located into the housing 22*c* and partially under the pump control ring 44*c*, is in connection to the pump inlet 50*c*.

A third control chamber 63*c* is formed between pump housing 22*c*, pump control ring 44*c*, seal 71*c* and seal 73*c* and is supplied in pressurized oil from the solenoid valve 91*c* via a feeding orifice 87*c*. As shown in FIGS. 10A-10D, pump 20*c* includes feeding orifice 81*c*, discharge passage 82*c* and connecting channel 83*c* in the pump control ring

44*c*. Pump 20*c* is designed and sized to create a pump pressure output as shown in FIG. 8. When third control chamber 63*c* is not pressurized, pump 20*c* generates pump pressure output curve A-B1-C1-D1-E1 as shown in FIGS. 10A-10D.

At curve portion A-B1, first control chamber 61*c* is energized and second control chamber 62*c* is not energized, since second control chamber 62*c* is vented to the inlet via discharge passage 82*c* and the connecting channel 83*c*. The feeding orifice 81*c* is not connected to second control chamber 62*c*, being completely covered by the pump control ring 44*c*. At low pump operating speeds, the force, acting as a turning moment, around the pivot pin 52*c* created by the pressure build up in first control chamber 61*c* is not sufficient to counter the force created by the return spring 56*c*, and as such the pump remains at maximum eccentricity.

At curve portion B1-C1, the pressure build up due to higher operating speeds of the pump has generated enough force from first control chamber 61*c*, acting as a turning moment, around the pivot pin 52*c* to exceed the force of the return spring 56*c*, acting as an opposing turning moment, around the pin, determining a reduction of the pump eccentricity. In this phase, the slight movement of the control ring 44*c* has not yet connected the feeding orifice 81*c* to the connecting channel 83*c*, hence only first control chamber 61*c* is still working.

Curve portion C1-D1 represents a transition phase, where the movement of the pump control ring started in portion B1-C1 has reached a point where the control channel 83*c* is changing second control chamber 62*c* connections, by connecting pressure feeding orifice 81*c* with second control chamber 62*c* and closing the second control chamber 62*c* connection to discharge passage 82*c*. As such, with further increase in pump operating speed and pressures, both first and second control chambers 61*c*, 62*c* are energized and a new force balance is established around pivot pin 52*c*. The pressure from first control chamber 61*c* acts against the force generated by the return spring 56*c* and the second control chamber 62*c*.

At curve portion D1-E1, the pressure build up due to higher operating speeds of the pump has generated enough force from the first control chamber 61*c*, acting as a turning moment, around the pivot pin 52*c* to exceed the force of the return spring 56*c* combined with the force from second control chamber 62*c*, determining a reduction of the pump eccentricity.

Pressure curve A-B2-C2-D2-E2 is generated in a similar fashion when solenoid valve 91*c* is emerged. Pressurized working fluid is provided to third control chamber 63*c* via the feeding orifice 87*c*.

Figure 11:
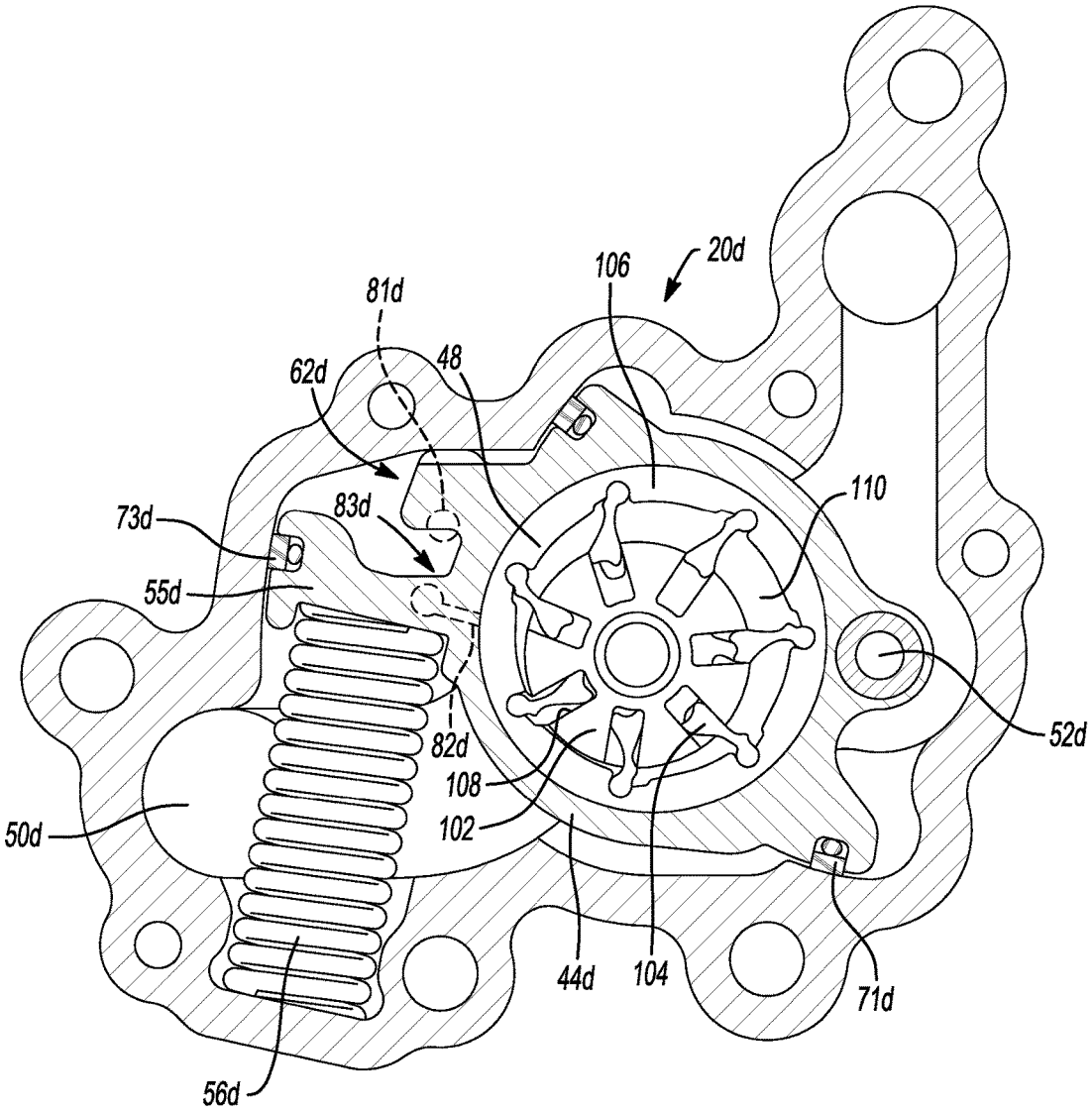
FIG. 11 is a partial plan view of a variable capacity pump including a pendulum slider mechanism.

FIG. 11 depicts another alternate pump identified at 20*d*. Pump 20*d* is substantially similar to pump 20, with the exception that the pumping members used to urge fluid from the inlet to the outlet are configured as a pendulum-slide cell instead of the vane arrangement previously described. Accordingly, like elements will retain their previously introduced reference numerals including a "d" suffix. Pump 20*d* includes an inner rotor 102 coupled to a plurality of pendulum slides 104 via an outer rotor 106. Pendulum slides 104 are pivotally mounted to outer rotor 106. Pendulum slides 104 are movable within radially extending slots 108 extending into inner rotor 102. Inner rotor 102 together with pendulum slides 104 and outer rotor 106 define pumping chamber 110. According to the rotational position of inner rotor 102, outer rotor 106, pumping chambers 110 serve as suction chambers or as pressure chambers for transferring fluid. It should be appreciated with either the outer rotor 106 or the inner rotor 102 may be a driven member of pump 20*d*.

The above-described configurations are intended to be examples and alterations and modifications may be effected thereto, by those of skill in the art, without departing from the scope of the present disclosure.

Moreover, it will be obvious to those skilled in the art that additional control chambers can be configured on either side of the pivot pin and these could be passively controlled by additional similar features in the control ring and therefore responsive to movement of the control ring. One or more of the control chambers may be actively controlled by an electrically operated solenoid valve to optimize the volume and pressure output characteristics of a pump to suit a given application.

What is claimed is:

1. A variable capacity pump, comprising:

a pump casing including a pump chamber, an inlet and an outlet;

a pump member movably positioned within the pump chamber, the pump member pumping a fluid from the inlet, through the pump chamber and to the outlet;

a control ring being movable within the pump casing to alter the volumetric capacity of the pump;

first and second control chambers at least partially defined by the pump casing and the control ring, the control chambers operable to individually receive pressurized fluid to create individual forces to bias the control ring toward a first position corresponding to a minimum volumetric capacity of the pump;

a return spring urging the control ring toward a second position corresponding to a maximum volumetric capacity of the pump, a force of the return spring acting against a combined force generated by the pressurized fluid within the control chambers to establish a first equilibrium pressure, wherein the control ring connects and disconnects the second control chamber from a source of the pressurized fluid based on a position of the control ring, the return spring acting against the force of the first control chamber to establish a secondary equilibrium pressure when the second control chamber is disconnected from the source of pressurized fluid.

2. The variable capacity pump of claim 1, wherein the control ring includes a channel connecting and disconnecting the second control chamber with the source of pressurized fluid based on the position of the control ring.

3. The variable capacity pump of claim 2, wherein the channel connects and disconnects the second control chamber with a discharge passage, the channel being connected to the discharge passage to reduce the fluid pressure within the second control chamber when the control ring is in a position disconnecting the pressurized fluid source from the second control chamber.

4. The variable capacity pump of claim 3, wherein the control ring blocks an opening to the discharge passage when the channel connects the pressurized fluid source and the second control chamber.

5. The variable capacity pump of claim 3, wherein the channel includes a blind recess extending along a surface of the control ring that slides relative to the pump casing.

6. The variable capacity pump of claim 2, wherein the channel extends across a width of the control ring in a direction perpendicular to a direction that the control ring moves.

7. The variable capacity pump of claim 1, wherein the pump casing includes a supply passage having a feeding orifice in fluid communication with the pressurized fluid source, the feeding orifice being positioned within the pump chamber and selectively blocked based on the position of the control ring.

8. The variable capacity pump of claim 1, wherein the pump member is positioned within a cavity of the control ring.

9. The variable capacity pump of claim 8, wherein the pump member is driven by a rotatable rotor.

10. The variable capacity pump of claim 1, further including a third control chamber at least partially defined by the control ring and the pump casing and operable to receive pressurized fluid to create a force urging the control ring toward the first position.

11. The variable capacity pump of claim 10, further including an electrically operated hydraulic solenoid valve to control the supply of pressurized fluid to the third control chamber, the pump outputting fluid according to a high mode pressure curve when the third control chamber is not supplied with pressurized fluid, and a low mode pressure curve when the third control chamber is supplied with pressurized fluid.

12. The variable capacity pump of claim 11, wherein the electrically operated hydraulic solenoid valve is an on/off type.

13. The variable capacity pump of claim 11, wherein the electrically operated hydraulic solenoid valve is a proportional type operable to modulate the pressure in the third control chamber between a pump outlet pressure and either atmospheric pressure or a pump inlet pressure.

14. The variable capacity pump of claim 1, further including an inner rotor and an outer rotor positioned within a cavity of the control ring.

15. The variable capacity pump of claim 14, wherein the pump member includes a pendulum slide coupled to one of the inner and outer rotors.

16. The variable capacity pump of claim 1, further including a rotor rotatably positioned within the pump chamber and wherein the pump member includes a plurality of vanes engaging the rotor and the control ring.

17. A variable capacity pump, comprising:

a pump casing including a pump chamber, an inlet and an outlet;

a pump member movably positioned within the pump chamber, the pump member pumping a fluid from the inlet, through the pump chamber and to the outlet;

a control ring being movable within the pump casing to alter the volumetric capacity of the pump;

first and second control chambers at least partially defined by the pump casing and the control ring, the first control chamber operable to receive pressurized fluid to create a force urging the control ring toward a first position corresponding to a minimum volumetric capacity of the pump, the second control chamber operable to receive pressurized fluid to create a force urging the control ring toward a second position corresponding to a maximum volumetric capacity of the pump; and a return spring urging the control ring toward the second position, a force of the return spring acting against the force generated by the pressurized fluid within the first control chamber to establish a first equilibrium pressure, wherein the control ring connects and disconnects the second control chamber from a source of the pressurized fluid based on a position of the control ring, the return spring force acting with the force generated by the second control chamber and against the force generated by the first control chamber to establish a secondary equilibrium pressure when the second control chamber is connected to the source of pressurized fluid.

18. The variable capacity pump of claim 17, wherein the control ring includes a channel connecting and disconnecting the second control chamber with the source of pressurized fluid based on the position of the control ring.

19. The variable capacity pump of claim 18, wherein the channel connects and disconnects the second control chamber with a discharge passage, the channel being connected to the discharge passage to reduce the fluid pressure within the second control chamber when the control ring is in a position disconnecting the pressurized fluid source from the second control chamber.

20. The variable capacity pump of claim 18, wherein the control ring blocks an opening to the discharge passage when the channel connects the pressurized fluid source and the second control chamber.

21. The variable capacity pump of claim 18, wherein the channel includes a blind recess extending along a surface of the control ring that slides relative to the pump casing.

22. The variable capacity pump of claim 17, wherein the pump casing includes a supply passage having a feeding orifice in fluid communication with the pressurized fluid source, the feeding orifice being positioned within the pump chamber and selectively blocked based on the position of the control ring.

23. The variable capacity pump of claim 17, further including a third control chamber at least partially defined by the control ring and the pump casing and operable to receive pressurized fluid to create a force urging the control ring toward the first position.

24. The variable capacity pump of claim 23, further including an electrically operated hydraulic solenoid valve to control the supply of pressurized fluid to the third control chamber, the pump outputting fluid according to a high mode pressure curve when the third control chamber is not supply with pressurized fluid, and a low mode pressure curve when the third control chamber is supplied with pressurized fluid.

25. The variable capacity pump of claim 23, wherein the electrically operated hydraulic valve is an on/off type.

26. The variable capacity pump of claim 23, wherein the electrically operated hydraulic solenoid valve is a proportional type operable to modulate the pressure in the third control chamber between a pump outlet pressure and either atmospheric pressure or a pump inlet pressure.

27. The variable capacity pump of claim 17, further including an inner rotor and an outer rotor positioned within a cavity of the control ring.

28. The variable capacity pump of claim 27, wherein the pump member includes a pendulum slide coupled to one of the inner and outer rotors.

* * * * *